United States Patent [19]

Farrow

[11] 4,033,258

[45] July 5, 1977

[54] PRINTING APPARATUS

[75] Inventor: Harold F. Farrow, Hitchin, England

[73] Assignee: Colorflo Limited, London, England

[22] Filed: May 29, 1973

[21] Appl. No.: 364,304

[30] Foreign Application Priority Data

May 30, 1972 United Kingdom ..... 25329/72

[52] U.S. Cl. ..... 101/158; 101/170

[51] Int. Cl.[2] ..... B41M 1/10; B41F 3/00

[58] Field of Search ..... 101/170, 187, 366, 252, 101/158–162, 151, 150

[56] References Cited

UNITED STATES PATENTS

| | | | |
|---|---|---|---|
| 632,766 | 9/1899 | Stone | 101/270 |
| 700,493 | 5/1902 | Herzog | 101/158 |
| 1,499,998 | 7/1924 | Ormond | 101/187 |
| 2,246,729 | 6/1941 | Gutberlet | 101/163 |
| 2,502,806 | 4/1950 | Staude | 101/252 |
| 3,056,384 | 10/1962 | Beale et al. | 118/411 |
| 3,543,682 | 12/1970 | Farrow | 101/366 |

*Primary Examiner*—J. Reed Fisher

[57] ABSTRACT

An improved printing apparatus and method utilizes a plurality of compressible injector units to apply ink of different colors to the face surface of a printing plate disposed at an inking station. After the injector units have been compressed to apply ink to the face surface of the printing plate, a transfer roller is moved across the surface of the printing plate. The transfer roller is then moved from the inking station to a printing station and applies ink received from the face surface of the printing plate to sheet material at the printing station.

11 Claims, 6 Drawing Figures

104
98
102
106
80
140
130
132
82
68
138
126
124
134
66
62
120
11
72
118
86
94
96
56
74
76
122
116
114
60
58
90
88
92
43
112
64
110
108
44
14
28
100
50
84
52
78
160
158
48
146
54
46

PRINTING APPARATUS

This invention relates to intaglio printing.

A method of printing in accordance with the invention comprises compressing at least one injector pump to inject printing fluid via passages through the thickness of an intaglio printing plate into the recessed design in the printing face of the plate, applying an offset roller to the printing face of the plate so as to offset an impression onto the roller and applying the roller to the surface to be printed so as to transfer the offset impression to said surface. The printing plate and a counter plate are preferably urged together during injection of the printing fluid.

This method may be put into effect by intaglio printing apparatus in accordance with the invention in which in use printing fluid is fed via passages through the thickness of the printing plate into the recessed design in the printing face of the plate by compression of at least one injector pump and which includes an offset roller mounted for rolling movement over the printing face of the printing plate and over the surface to be printed.

The apparatus preferably includes a counter plate and means for urging the counter plate and printing surface of the printing plate together during the said injection of the printing fluid.

The offset roller is preferably mounted for movement in one direction around an endless path passing from a home position over the printing plate in rolling contact therewith, over the surface to be printed in rolling contact therewith and then returning directly to the home position without rolling over either the surface to be printed or the printing plate.

If differently coloured printing material is fed into different channels then the parts of the design to be printed which communicate with these channels will be printed in the different colours.

One embodiment of the invention will now be described by way of example with reference to the accompanying drawings in which.

Figure 1:
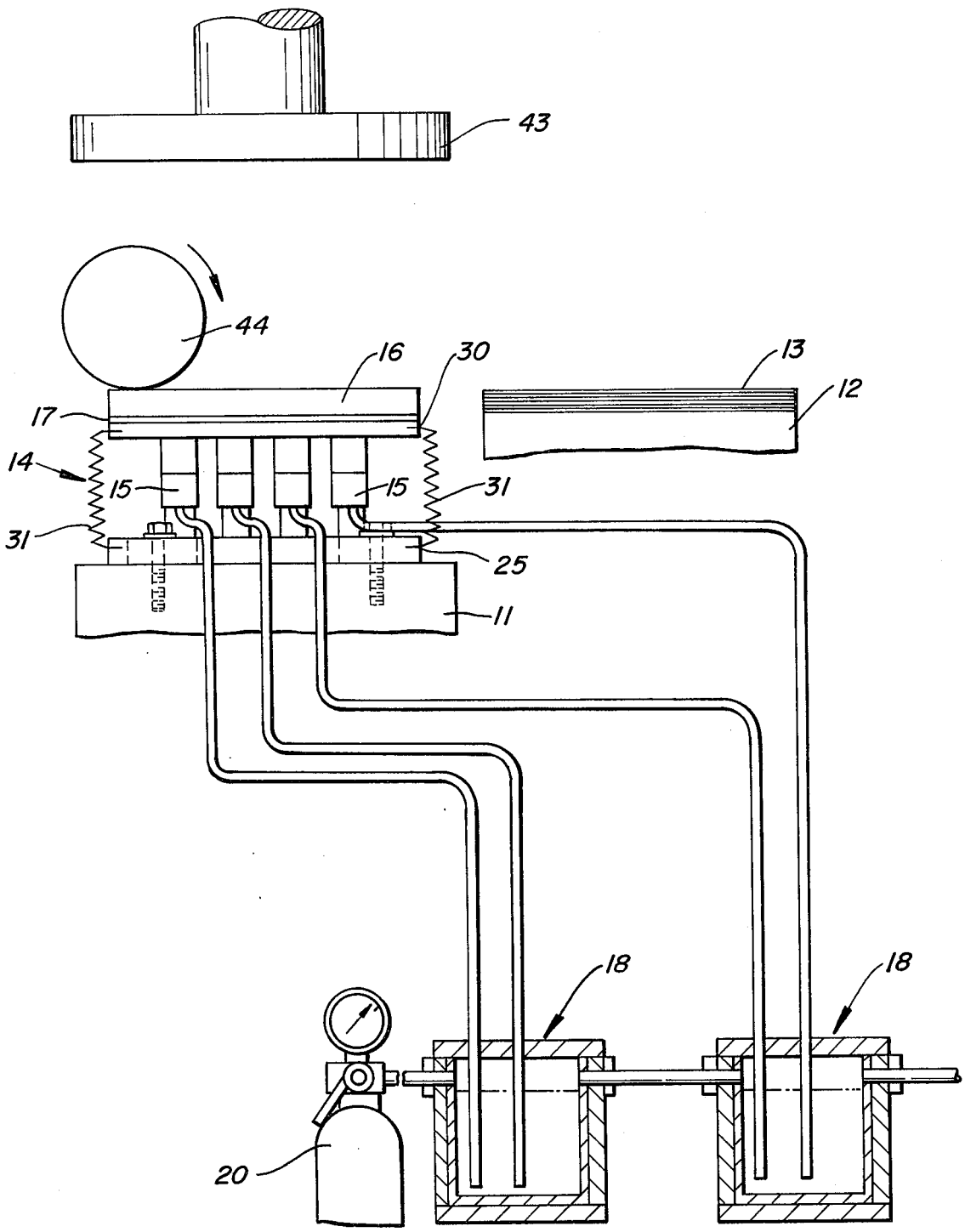
FIG. 1 is a diagrammatic elevation of an embodiment of the invention.
Figure 2:
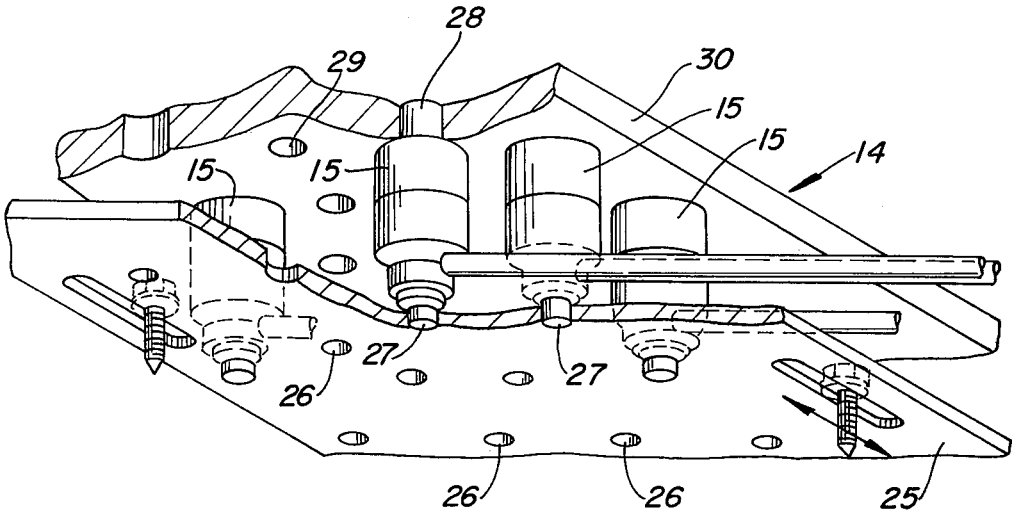
FIG. 2 is a diagrammatic perspective view of the injector units positioned in the embodiment of FIG. 1.
Figure 3:
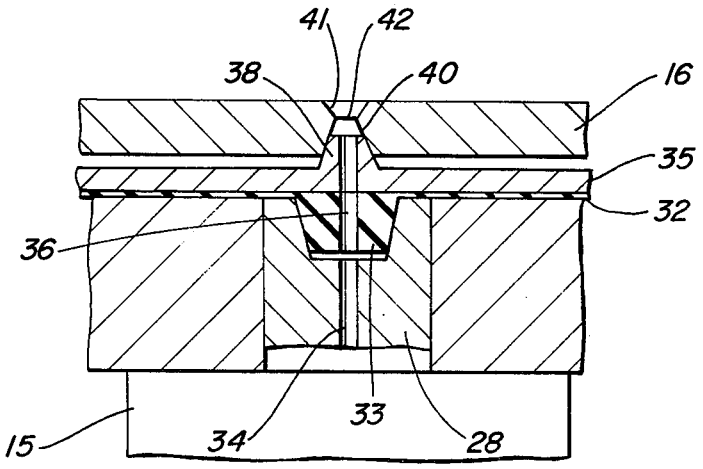
FIG. 3 is a sectional view through a part of the printing plate and gasket plate of the embodiment of FIG. 1.

Referring to FIGS. 1–3 the printing apparatus comprises a press member 11, and an anvil member 12 on which material 13 to be printed is positioned. The member 11 carries a printing head, generally shown at 14, which includes a plurality of ink injector units 15, an intaglio die or printing plate 16 having a recess corresponding with the design of the material to be deposited, and a gasket 17 interposed between the die plate 16 and the injector units 15.

The fluid injector units 15, which may each conveniently be as described in the specification of our British Pat. Nos. 1,241,793 and 1,241,794, are each connected with a source 18 of fluid e.g., ink or the like for printing on the mateial 13.

Whilst each of the sources 18 may have differently coloured ink or the like and be connected with individual injector units, a single source may be connected with a plurality of injector units. For example in FIG. 1, two fluid sources are illustrated as connected with two separate fluid injector units. Each of the fluid sources 18 is connected with a supply of a suitable gas 20, such as nitrogen, which provides a pressurised atmosphere above the supply of fluid in the source and which functions to aid in directing or forcing the fluid in the fluid sources 18 into the injector units 15, as will be apparent from the description which follows.

As best seen in FIG. 2 the unit 14 includes a plate 25 having a plurality of openings 26 therein. The openings 26 in the plate 25 are adapted to receive a pilot portion 27 of each of the injector units 15. Each injector unit 15 also has a nozzle portion 28 which is adapted to be positioned in an opening 29 in a die or printing plate support plate 30, aligned with the openings 27 in the plate 25. The plate 30, as well as the plate 25, may have any arrangement of openings therein desired for purposes of mounting individual injector units 15 therebetween, as may be dictated by the particular job being performed. Moreover, dummy injector units, that is, injector units which are not connected with a fluid supply 18 may be positioned in these openings as well.

The plate 25 is constructed so as to be readily secured to the member 11.

The support plate 30 is constructed so that the die plate 16 and the resilient gasket 17 may be readily attached thereto and for the purpose of providing a unitary construction, the plate 25 may be secured to the plate 30 by suitable securing means, or the members may be held together by suitable springs, schematically shown in FIG. 1 at 31. It should be apparent that a unitary construction is provided so that the printing head as a whole i.e., the plate 25, the fluid injector units 15, die plate 16, gasket 17 and plate 30 can be removed and fitted together. Also, it should be apparent that upon release of the fasteners which secure the plate 16 and the resilient gasket 17 to the plate 30, a different plate having a different design therein may be secured to the plate 30 for purposes of printing a different job.

The gasket plate 17 comprises a laminate of a layer 32 of rubber bonded to the upperside of a metal plate 35 for stiffness, the rubber layer 32 being about 0.005 inches thick. The rubber layer 32 is formed with a series of outwardly projecting pips 33 each aligned with and projecting into the nozzle 28 of a respective injector unit 15 (see FIG. 3) with the outlet holes 34 through the nozzles 28 aligned with holes 36 passing through the pips. Only those pips which communicate with injectors connected to a fluid supply source are provided with the holes 36 which pass through the plate and through projecting ribs 38 formed on the other surface 33 of the plate.

The ribs 38 are arranged in a pattern which corresponds exactly to the pattern of channels 40 on the back of the printing plate or die 16. Both the ribs and channels having sloping sides and the ribs are made somewhat thicker than the channels so that the sides of the ribs seal against the sides of the channels with the face of the gasket held spaced from the corresponding face of the die plate by for example 0.01 inch and the outer face of the ribs spaced from the bottom of the channels.

When multi-coloured printing is to be carried out each of the channels 40 on the back of the printing plate is arranged to feed those parts of the recessed design 41 on the front of the intaglio plate which are to print in a single colour through holes 42 passing through the plate.

Each channel is itself fed with ink or the like of a single colour from an injector or injectors connected to one of the ink supply sources, through the hole 36 in the pip or pips communicating with that or those injectors, the ink flowing through the space beween the outer face of the ribs and the bottom of the channels. In this way multi-coloured printing is achieved with the parts of the design of one colour being fed separately from that or those of the other colour or colours.

The gasket plate 17 is described in more detail in the Complete Specification of our co-pending Patent Application No. 10883/71 wherein is also described a distributor plate which may be used in the present invention for distribution of printing fluids to areas of the printing plate.

A reciprocating counter plate 43 is mounted above the n ember 11 for movement to and from a position in pressure contact with the printing plate 16. Such contact compresses the injector units 15 which act to inject printing fluid via the passages 36, distribution channels 40 and holes 42 into the recessed design 41 in the plate so 'inking' or charging the plate.

The counter plate 43 is then retracted and an offset roller 44, which may be rubber or rubber coated, is rolled from left to right across the plate in light contact therewith and then rolled across the stock 13 so transferring the intaglio-image thereto. The counter 43 is brought into pressure engagement with the printing plate and the process is repeated to transfer the image to a new piece of stock.

In an alternative arrangement the counter 43 is dispensed with and sufficient pressure is applied to the printing plate 16 by the roller 44 to operate the injector units to charge the plate.

Offsetting the intaglio printing in accordance with the invention may enable the thickness of the ink or other printed fluid to be controlled accurately particularly on such difficult-to-print materials as textiles, aluminum foil, plastics film, corrugated board etc.

Figure 4:
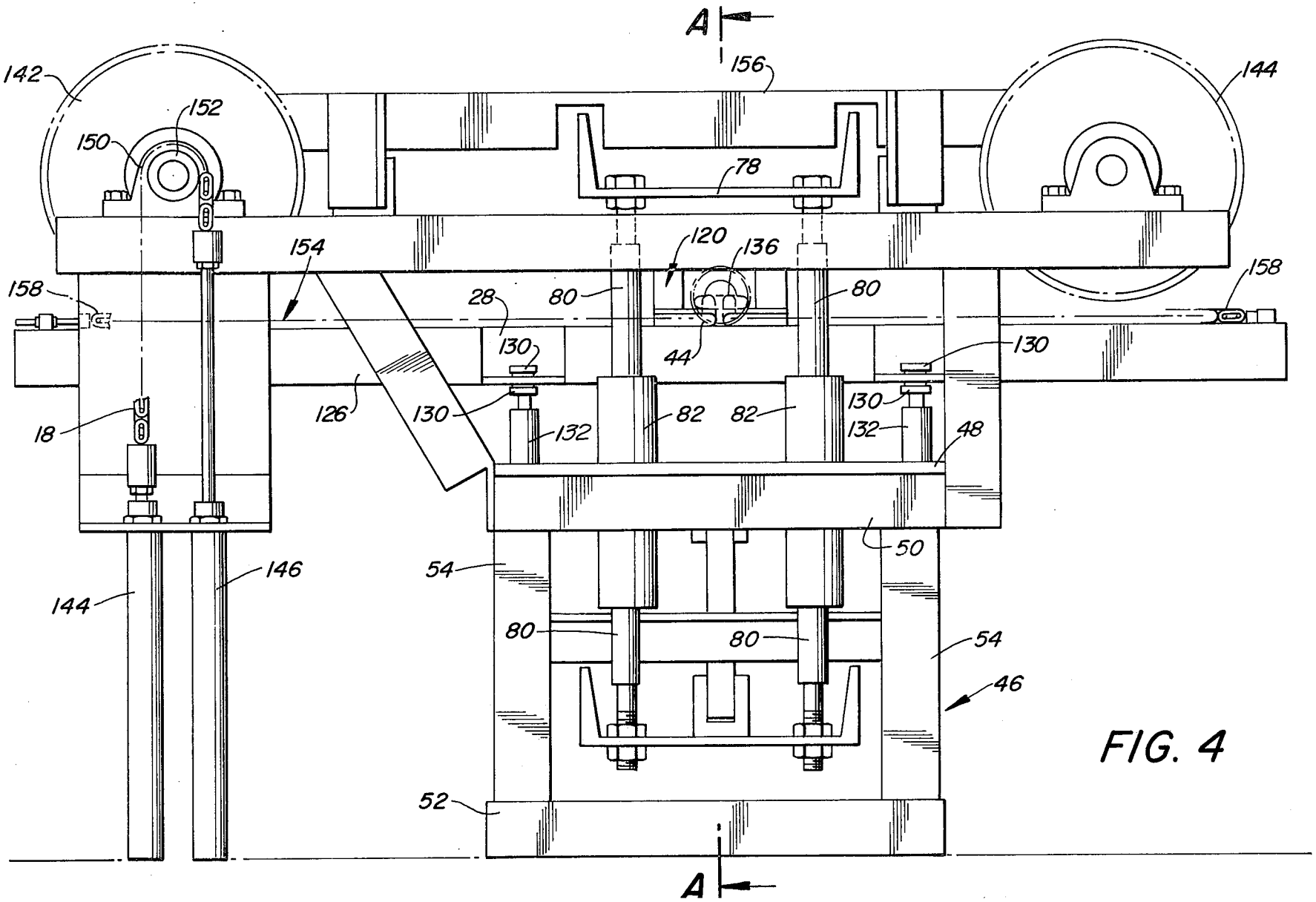
FIG. 4 is a side view, in more detail of a printing apparatus in accordance with the invention.
Figure 5:
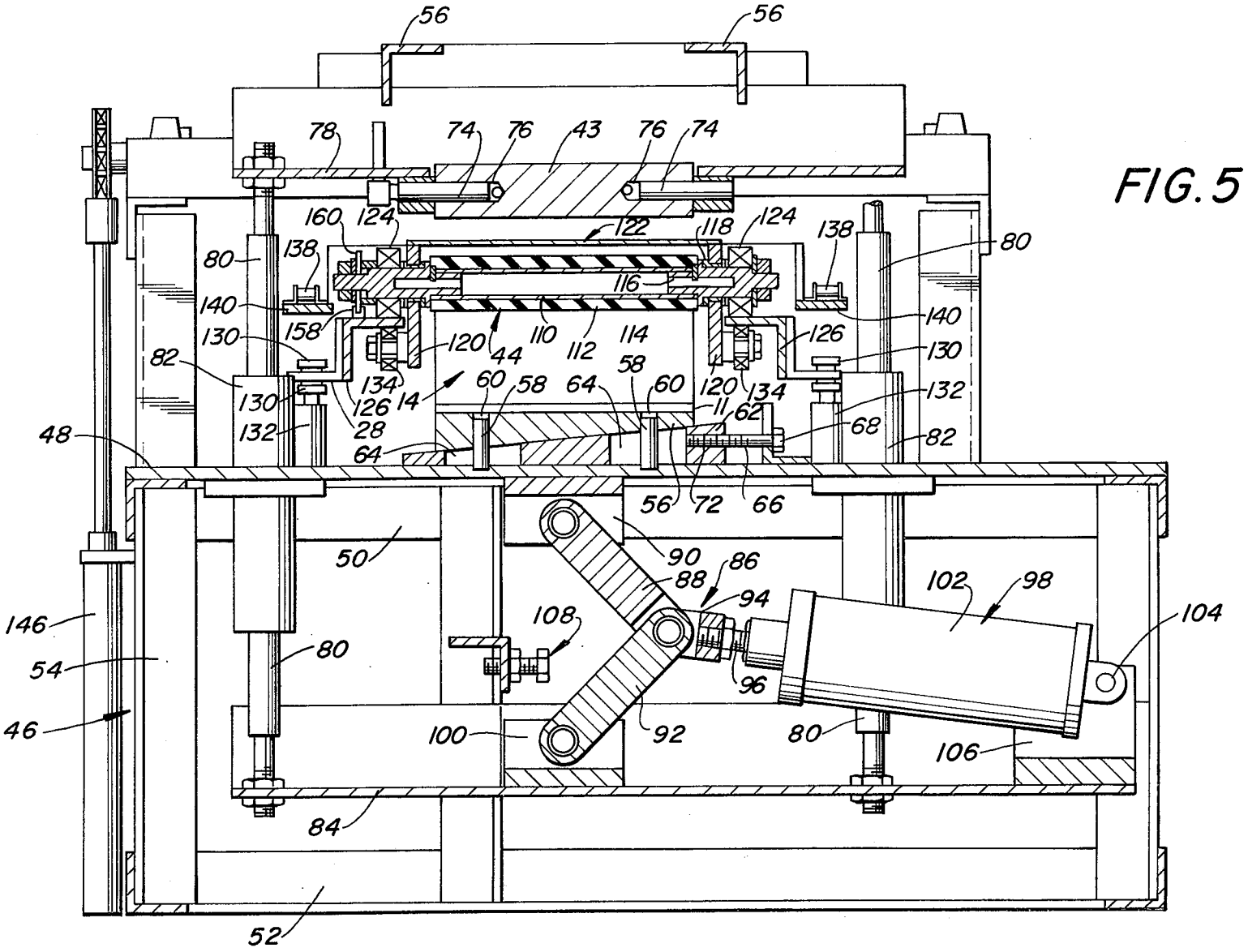
FIG. 5 is a cross-section on arrows A—A of the apparatus of FIG. 4.

Referring now to the more detailed drawings of FIGS. 4 and 5, the printing machine has a table 46 comprising a table top 48 supported by upper and lower rectangular frames 50 and 52 which are spaced apart by vertical corner posts 54.

The member 11 for receiving the printing head 14 (which is not shown in detail in this drawing) is mounted on the table top 48 by a wedge member 56 which is slideable vertically on pins 58 which engage in holes 60 in the wedge member. A second wedge member 62 is positioned between the wedge member 56 and the table top 48 and has two elongate slots 64 through which the pins 58 pass enabling the wedge member 62 to slide relatively to the wedge member 56 so adjusting the spacing of the member 11 from the table top. The position of the wedge member 62 can be set by means of a screw adjusting member 66 which has a hexagonal head 68 held captive by a bracket 70 and which engages in a threaded hole 72 in the end of the wedge member. Rotation of the screw threaded member 68 thus slides the wedge member 62 along the table top.

Opposed to the printing head receiving member 11 the counter plate 43 is accurately positioned by dowels 74 engaging in holes 76 in the plate on a platform 78. The platform 78 is supported at its corners by four posts 80 which slideably pass through bushes 82 in the table top 48. The corner posts 80 are mounted at their lower end, beneath the table top, on a lower platform 84. The platform 84 is linked to the underside of the table top 48 by a toggle mechanism 86 comprising a link 88 which is pivotally connected at one end to a bracket 90 mounted on the underside of the table top. The other end of the link 88 is pivotally connected to one end of a second link 92 and by means of a bracket 94 to the piston rod 96 the pneumatic ram 98. The other end of the link 92 is pivotally connected to a bracket 100 which is mounted on the upper side of the lower platform 84. A cylinder 102 of the pneumatic ram 98 is pivotally connected at 104 to a bracket 106 mounted on the upper side of the lower platform 84.

When a pneumatic pressure is applied to the hydrauligram to extend the piston therefrom the toggle mechanism tends to straighten out so urging the lower platform, and thus the upper platform and counter plate 43 downwardly until the extension of the piston 96 is arrested by a stop 108. The counter plate 43 is thus urged downwardly against the printing face of the printing plate so compressing the injection pumps 15 and supplying ink to the recesses of the intaglio design. It should be noted that the offset roller 44 is not in the position illustrated in FIGS. 4 and 5 when this happens.

The offset roller 44 comprises a tubular steel core 110 having a rubber or the like outer sheath 112. The roller is supported at its ends by stub axles 114 to which it is keyed by pins 116. The stub axles 114 are journalled in bearings 118 in the arms 120 of a U-shaped cradle 122. The stub axles pass right through the arms 120 and two wheels 124 are freely rotatably mounted thereon. The wheels 124 may conveniently comprise ordinary bearing races. The wheels 124 are arranged to run on the upper surface of a pair of angle section rails which are adjustably mounted by lock nuts 130 on four posts 132, the posts then being mounted on the table top 48. The height of the roller 44 above the table top 48 can thus be adjusted to accommodate adjustments in the height of the printing plate above the table top 48.

In order to maintain the roller 44 in light rolling contact with the printing plate and to prevent the wheels 124 from lifting off the rails 126 two further wheels 134 are mounted beneath the rails 126 on each cradle arm 120. The wheels 134 may also conveniently comprise ordinary bearing races.

An endless chain 136 is fixed at 138 to a bracket 140 on each side of the cradle 122. The chain 136 runs round two sprockets 142 and 144. The sprocket 142 is driven to rotate in increments by two alternating pneumatic rams 144 and 146 which act to reciprocate a chain 148. The chain passes around a sprocket 150 which drives the sprocket 142 via a one way drive or free wheel 152.

After the counter plate 43 has been urged down onto the printing plate to compress the injector pumps 15 and thus ink the plate by operation of the pneumatic ram 98 the pneumatic rams 144 and 146 are operated so as to cause the chain 136 to pull the carriage 122 along the rails 126 so that the offset roller 44 rolls lightly over the surface of the printing plate and then over the material to be printed at the position indicated at 154 so transferring the impression to the material to be printed. Further operation of the pneumatic rams 144 and 146 cause the chain 136 to carry the cradle 122 beyond the ends of the rails 126 and round the sprocket 142. The cradle then travels (upside-down) towards the sprocket 144 its weight being supported by two further rails 156 which engage with the wheels 124 and 134. The continued operation of the pneumatic rams 144 and 146 bring the cradle 122 round to the sprocket 144 and the wheels 124 and 134 again engage the two rails 126 so that the offset roller is again in a position to pass over the printing plate which has in the meantime been reinked by operation of the pneumatic ram 98.

Only one cradle and offset roller assembly is illustrated in FIGS. 4 and 5; however, two or more rollers equally spaced around the chain 136 may conveniently be used.

In order to ensure non-slip rotary motion to the offset roller 44, a proper register between the image transferred by the offset roller 44 and the material to be printed on a fixed chain 158 runs along the top surface of the left-hand rail 126, as viewed in FIG. 5. The stub axle 114 at the left-hand side of the offset roller 44, as viewed in FIG. 5, carries a sprocket 160 which engages with the fixed chain 158 so as to ensure that the roller rotates constantly during its run along the rails 126.

Before the roller passes over the printing plate, it is preferably wiped clean either by hand or by automatic means not illustrated.

The stroke of the injector pumps 15 may be varied by adjusting the height of the printing plate above the table top 48 by adjustment of the screw adjustment member 66. The further the printing plate is spaced from the table top 48, the greater will be the compression of the injector pumps by the counter plate 43.

Figure 6:
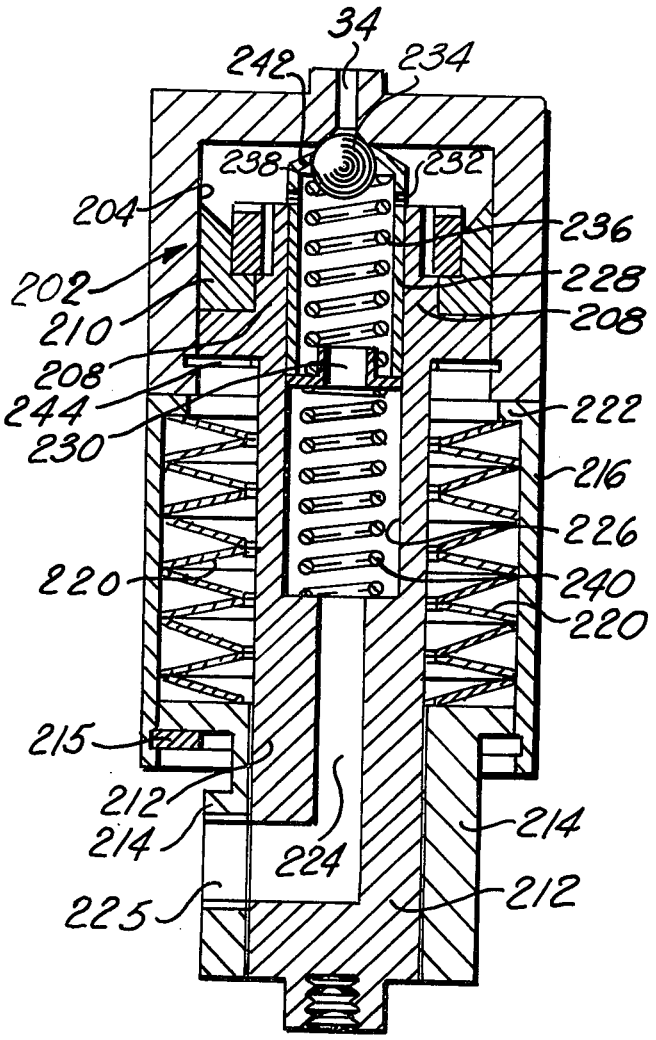
FIG. 6 is a cross sectional view of an injector unit utilized in the printing apparatus of FIG. 2.

One of the injector units 15 is illustrated in FIG. 6 and comprises a member 202 the interior chamber 204 of which constitutes a "pump" chamber and is intended to communicate with a recessed design or engraving on the printing surface of the intaglio printing plate 16 through an outlet passage 34. A piston 208 works in the chamber 204 and is provided with a sliding seal member 210 to provide a seal between the piston and the chamber. The upper portion of the piston rod 212 and is secured to a support member 214 having a head 215 which is arranged for limited sliding movement in a cylinder 216 which rests on the top of the walls of the member 202. As pressure is applied to the piston rod during printing by means of the plates 25 and 30 under the influence of the counter plate 43, the member 214 moves down within the cylinder 216 compressing a spring 220 which is located between the head 215 of the member 214 and bottom wall 222 of the cylinder so as to apply pressure to the member 202 through the spring.

The piston 208 and its rod 212 are formed with an internal passage 224 communicating at the upper end with an opening 225 through the member 214 for connection to a supply of printing ink. The lower portion of the passage 224 is of larger diameter to provide a cylinder 226 carrying a relief or auxiliary piston 228 which is hollow and which communicates with the cylinder 226 through an opening 230 and with the chamber 204 through chamber inlet openings 232.

The piston 228 which is a sliding fit in the cylinder 226 carries a ball valve 234 at its lower end which is normally biased by means of a spring 236 within the piston to a position in which it closes a relief passage 238 from the piston to the chamber 204. The piston itself is biased by means of a spring 240, located within the cylinder 226 to a position in which the ball valve 234 closes communication between the chamber 204 and its outlet passage 34.

During use of the mechanism, pressure is applied by the counter plate 43 to the piston rod 212 and support member 214. Further, when the spring pressure is overcome further pressure causes the piston 208 to move to contract the chamber 204 and hence apply pressure to the printing ink in the chamber. During the initial movement of the piston in the chamber the outlet 34 remains closed by the outlet valve 234 and the inlet valve 232 is open so that ink within the chamber 204 can flow back through the relief piston 228 and up through the passage 224 in the main piston to the ink supply. However, as the pressure increases and the piston 208 moves in the chamber 204 over the relief piston 228 overcoming the pressure of spring 240, the head of the piston 208 acts as a valve device to close the ports 232 so that communication between the chamber 204 and the ink supply is cut off. When the pressure in the chamber 204 has built up sufficiently the pressure acting on the tapered nose 242 of the relief piston 228 causes this piston to move up into the cylinder 226 against the pressure of the spring 240 so as to open the passage through the printing plate to the chamber 204 allowing printing ink to reach the intaglio surface of the plate.

When sufficient ink has been supplied to service the intaglio plate excess ink is returned to the supply via the relief passage 238 on lifting of the ball valve 234 from its seat by the excess pressure of the ink in the chamber 204.

As the pressure is relaxed the pressure on the relief piston 228 within the chamber is also relaxed allowing the spring 240 to move the piston 228 back to the position in which the passage 34 is closed by the ball valve 234. In this position ink is no longer fed to the intaglio recess thus avoiding the possibility of excess ink being supplied.

As the pressure is further relaxed the spring 220 moves the main piston 8 upwardly within the chamber 204 to the position shown in the drawings in which it abuts against the stop 244 and as the chamber 204 is expanded and as the ports 232 are now open ink is drawn through the supply opening 225 the passage 224 the cylinder 226 and the opening 230 into the chamber 204 ready for the next operation.

I claim:

1. A printing apparatus comprising a printing station, an inking station spaced apart from said printing station, a printing plate at said inking station, said printing plate including a face surface with a design formed thereon and a plurality of passages extending through said printing plate into fluid communication with said design, a plurality of resiliently compressible injector units disposed at said inking station and connected in fluid communication with the face surface of said printing plate through said passages, each of said injector units including means for enabling ink to flow from the injector unit through at least one of said passages in said printing plate onto the face surface of said printing plate upon compression of the injector unit, means for compressing said injector units to provide a flow of ink from said injector units through said passages in said printing plate and onto the face surface of said printing plate, and transfer means for transferring ink from the face surface of said printing plate to sheet material disposed at said printing station, said transfer means including surface means for engaging the face surface of said printing plate at the inking station to thereby apply ink to said surface means, and means for moving said surface means with ink disposed thereon from said inking station to said printing station and for effecting a transfer of ink from said surface means to sheet material at said printing station.

2. An apparatus as set forth in claim 1 wherein said surface means has a cylindrical configuration, said means for moving said surface means including means for effecting rolling movement of said surface means at least part way across the face surface of said printing plate and for thereafter effecting rolling movement of said surface means at least part way across the sheet material at the printing station.

3. An apparatus as set forth in claim 1 wherein said means for compressing said injector units includes a counter plate, and means for moving said counter plate and printing plate relative to each other to compress said injector units.

4. An apparatus as set forth in claim 1 further including means for conducting ink of a first color to one of said injector units, and means for conducting ink of a second color which is different from said first color to another of said injector units.

5. A printing apparatus comprising a printing station, an inking station spaced apart from said printing station, a printing plate disposed at said inking station, said printing plate having a face surface with a design formed thereon, a plurality of resiliently compressible injector units disposed at said inking station, passage means for connecting each of said injector units in fluid communication with the face surface of said printing plate, each of said resiliently compressible injector units including means for effecting a flow of ink through said passage means to the face surface of said printing plate upon compression of the injector unit, a movable counter plate disposed at said inking station, first drive means for moving said counter plate along a first path from a retracted position spaced apart from said printing plate to a position disposed adjacent to the printing plate, for thereafter continuing movement of said counter plate along said first path against the influence of said injector units to resiliently compress said injector units and effect a flow in ink from said injector units to the face surface of said printing plate, and for moving said counter plate back to said retracted position after said injector units have been compressed, an ink transfer roller, said ink transfer roller including surface means for receiving ink from the face surface of the printing plate at the inking station and for applying ink to the sheet material at the printing station, and second drive means for moving said transfer roller along a second path extending between the inking station and the printing station, a portion of said second path being disposed between said counter plate and said printing plate when said counter plate is in the retracted position.

6. An apparatus as set forth in claim 5 wherein said second path is an endless path, said second drive means including at least one chain connected with said transfer roller and extending along the second path and sprocket means for effecting movement of said chain.

7. An apparatus as set forth in claim 5 further including means for positively rotating said transfer roller as said transfer roller moves along at least a portion of said second path.

8. An apparatus as set forth in claim 7 wherein said means for positively rotating said transfer roller includes a longitudinally extending chain mounted in a fixed relationship with said inking and printing stations and a sprocket connected with said transfer roller and disposed in meshing engagement with said chain.

9. An apparatus as set forth in claim 5 further including first and second parallel rails extending through said inking and printing stations, each of said rails having a pair of opposed and longitudinally extending side surfaces, first and second wheel means connected with one end portion of said transfer roller for engaging the pair of longitudinally extending side surfaces on said first rail, and third and fourth wheel means connected with an end portion of said transfer roller opposite from said one end portion for engaging the longitudinally extending side surfaces on said second rail.

10. A method of printing comprising compressing at least one injector pump to inject printing fluid via passages through the thickness of an intaglio printing plate into the recessed design in the printing face of the plate, the printing plate and a counter plate being urged together during injection of the printing fluid, applying an offset roller to the printing face of the plate so as to offset an impression onto the roller and applying the roller to the surface to be printed so as to transfer the offset impression to said surface.

11. A method of printing as claimed in claim 10 wherein the pressure of injected printing fluid is relieved when it reaches a predetermined value.

* * * * *